United States Patent [19]

Swidler

[11] Patent Number: 5,045,425

[45] Date of Patent: Sep. 3, 1991

[54] ELECTROPHOTOGRAPHIC LIQUID DEVELOPER COMPOSITION AND NOVEL CHARGE DIRECTORS FOR USE THEREIN

[75] Inventor: Ronald Swidler, Palo Alto, Calif.

[73] Assignee: CommTech International Management Corporation, Menlo Park, Calif.

[21] Appl. No.: 398,460

[22] Filed: Aug. 25, 1989

[51] Int. Cl.[5] ..... G03G 9/00; G03G 5/00

[52] U.S. Cl. ..... 430/115; 430/115; 430/137; 430/112

[58] Field of Search ..... 430/112, 115, 137

[56] References Cited

U.S. PATENT DOCUMENTS

| | | | |
|---|---|---|---|
| 4,202,785 | 5/1980 | Merrill et al. . | |
| 4,206,064 | 6/1980 | Kiuchi et al. . | |
| 4,460,672 | 7/1984 | Gruber et al. . | |
| 4,556,624 | 12/1985 | Gruber et al. . | |
| 4,564,574 | 1/1986 | Uytterhoeven et al. . | |
| 4,654,282 | 3/1987 | Ng et al. . | |
| 4,663,265 | 5/1987 | Uytterhoeven et al. | 430/115 |
| 4,725,867 | 2/1988 | Ng et al. . | |
| 4,728,983 | 3/1988 | Zwadlo et al. . | |
| 4,789,616 | 12/1988 | Croucher et al. . | |
| 4,809,991 | 9/1989 | de Graft-Johnson et al. | 430/115 |
| 4,879,199 | 11/1989 | Gruber et al. . | |
| 4,897,332 | 1/1990 | Gibson et al. | 430/115 |
| 4,918,047 | 4/1990 | Ikeda et al. | 428/913 X |
| 4,925,766 | 5/1990 | Elmasry et al. . | |
| 4,946,753 | 8/1990 | Elmasry et al. . | |

FOREIGN PATENT DOCUMENTS

| | | | |
|---|---|---|---|
| 55-6220 | 2/1980 | Japan . | |
| 59-87463 | 5/1984 | Japan . | |
| 1069073 | 4/1986 | Japan | 430/115 |
| 2061949 | 3/1987 | Japan | 585/24 |
| 62-163061 | 7/1987 | Japan . | |
| 1442835 | 7/1976 | United Kingdom . | |

*Primary Examiner*—Marion E. McCamish
*Assistant Examiner*—Stephen C. Crossan
*Attorney, Agent, or Firm*—Dianne E. Reed

[57] ABSTRACT

An electrophotographic liquid developer composition is provided containing a charge director which is a salt of a trivalent metal and an aromatic acid such as diisopropyl salicylic acid. For consecutive color toning processes, it is preferred that the concentration of charge director be maintained below some defined maximum value so that substantially all of the charge director is associated with toner. Methods for making and using the novel compositions are provided as well.

17 Claims, 8 Drawing Sheets

ELECTROPHOTOGRAPHIC LIQUID DEVELOPER COMPOSITION AND NOVEL CHARGE DIRECTORS FOR USE THEREIN

TECHNICAL FIELD

This invention relates generally to the field of electrophotography, and more particularly relates to a liquid developer composition and to a novel class of charge directors for use in electrophotographic processes.

BACKGROUND

Preparation of printed images by electrophotographic (or "xerographic") processes involves coating a selected substrate, or xerographic plate (typically comprised of metal, glass or plastic), with a photoconductive insulating material such as selenium, and then providing an electrostatic charge on the photoconductive surface, e.g., by ionization from a corona discharge. A light image is then focused onto the charged surface, which discharges or lowers the potential of the irradiated areas, while leaving the remainder of the surface charged. The electrostatic image so formed is then made visible by application of a suitable developing composition, which may be in either dry or liquid form.

Conventional liquid developer compositions comprise a dispersion of pigment particles in an insulating carrier liquid. Application of such a composition to the substrate carrying the electrostatic image results in migration of charged pigment particles to the substrate surface and deposition thereon in conformance with the electrostatic image. The developed image is then transferred to another surface such as paper. (In some cases, it may be possible to eliminate the intermediate step of image transfer, i.e., so that the developed image is directly produced upon the final surface; see, e.g., U.S. Pat. No. 3,052,539 to Greig.)

The earliest liquid developers were dispersions of pigment particles such as carbon black in a petroleum distillate. To charge the pigment particles, a charge director such as a metal salt was incorporated into the developer composition. The main problem with these early developers was instability; the pigment tended to settle out of the dispersion medium. In addition, attractive forces between the pigment particles resulted in formation of large aggregates, in turn further destabilizing the dispersion and giving rise to a poor quality image. In an attempt to overcome these difficulties, resinous dispersants were incorporated into the composition.

Color liquid developers are relatively recent, and are similarly comprised of colorant imbibed in a thermoplastic resin core, these "toner" particles dispersed in an insulating carrier medium as above. The four-color liquid electrophotographic process in which these developers are currently used involves "consecutive color toning", a technique which comprises: (1) charging a photoconductive (pc) surface; (2) impressing a first latent image on the surface by exposure through a colored transparency; (3) developing the image by contacting the pc with a liquid developer composition of a first color, typically yellow; and (4) optically discharging the pc surface. The steps are then repeated in sequence, typically using magenta, cyan, and black developer compositions, i.e., the cyclic process is repeated until the colored image is complete.

A significant problem which has been encountered in consecutive color toning is "image" or "character" staining, that is to say, where a second process color overtones the first image in regions where portions of the first image should have been discharged but were not. See, for additional explanation of the problem, R. M. Schaffert, *Electrophotography* (London: Focal Press, 1975), at pp. 184–186.

Many schemes have been advanced to overcome this difficulty. In U.S. Pat. No. 4,701,387 to Alexandrovich et al., for example, the problem of residual toner is discussed. The inventors propose a solution wherein the developed surface is rinsed with a polar liquid after each development step. It is suggested that application of a polar rinse liquid neutralizes and solvates residual counterions deriving from charge control agents and stabilizers present in the liquid developer.

While the Alexandrovich et al. method may be effective in reducing the staining problem, such a multiple washing procedure is time-consuming and unwieldy (it is recommended in the '387 patent that "after each development step and before the next developer is applied, the developed image is rinsed. . . . After rinsing, the rinse liquid is removed from the photoconductive element by drying, wiping or other method. . . ."; see col. 2, lines 62–67).

The present invention is thus directed in part to the problem of image staining in consecutive color toning.

Other problems repeatedly encountered with prior art electrophotographic processes, generally, are poor resolution and poor image density. The present invention addresses these considerations as well.

The inventor herein has now discovered a new class of positive charge directors for use in liquid developer compositions. The novel charge directors surprisingly give rise to images which are of extremely high quality with respect to both resolution and image density. In addition, incorporation of the novel charge directors at a relatively low concentration, below a certain defined value, allows for color overtoning with virtually no image or character staining.

DESCRIPTION OF THE PRIOR ART

R. M. Schaffert, *Electrophotography* (London: Focal Press, 1975), provides a comprehensive overview of electrophotographic processes and techniques. Representative references which relate to the field of color electrophotography, specifically, include U.S. Pat. Nos. 3,060,021 to Greig, 3,253,913 to Smith et al., 3,285,837 to Neber, 3,337,340 to Matkan, 3,553,093 to Putnam et al., 3,672,887 to Matsumoto et al., 3,687,661 to Sato et al., and 3,849,165 to Stahly et al. References which describe electrophotographic toners and developers include U.S. Pat. Nos. 2,986,521 to Wielicki, 3,345,293 to Bartoszewicz et al., 3,406,062 to Michalchik, 3,779,924 to Chechak, and 3,788,995 to Stahly et al.

References which relate to charge directors, also sometimes referred in this and related applications as "charge control agents", include U.S. Pat. Nos. 3,012,969 to van der Minne et al. (polyvalent metal organic salts in combination with an oxygen-containing organic compound), 3,411,936 to Rotsman et al. (metallic soaps), 3,417,019 to Beyer (metallic soaps and organic surface active agents), 3,788,995 to Stahly et al. (various polymeric agents), 4,170,563 to Merrill et al. (phosphonates), 4,229,513 (quaternary ammonium polymers), 4,762,764 to Ng (polybutene succinimide, lecithin, basic barium petroleum sulfonates, and mixtures thereof), and *Research Disclosure*, May 1973, at page 66.

U.S. Pat. No. 4,701,387 to Alexandrovich et al., discussed in the preceding section, and U.S. Pat. No. 3,337,340 to Matkan, are relevant insofar as each of these references relates to the problem of image staining in consecutive color toning.

SUMMARY OF THE INVENTION

It is a primary object of the present invention to provide an electrophotographic liquid developer composition which gives a high resolution, high density final image, and to provide novel positive charge directors for use in such a composition.

It is another object of the invention to provide an electrophotographic liquid developer composition which provides for virtually complete elimination of image staining in consecutive color toning.

It is still another object of the invention to provide a method for preparing such a liquid electrophotographic liquid developer composition.

It is yet another object of the invention to provide such a method wherein charge director concentration in the liquid developer composition is maintained below a certain value.

It is a further object of the invention to provide a method for developing an electrostatic charge pattern using the novel developer composition.

It is still a further object of the invention to provide a consecutive color toning method using the novel developer composition.

Additional objects, advantages and novel features of the invention will be set forth in part in the description which follows, and in part will become apparent to those skilled in the art upon examination of the following, or may be learned by practice of the invention.

The above objects are accomplished in accordance with the present invention by providing an electrophotographic liquid developer composition comprising, dispersed in an electrically insulating carrier liquid, (a) toner particles of a resinous phase containing a colorant, and (b) a charge director soluble in said carrier liquid which associates with the toner particles to form charged complexes, wherein the charge director is a salt of a trivalent metal and an aromatic acid represented by either of structures (I) or (II)

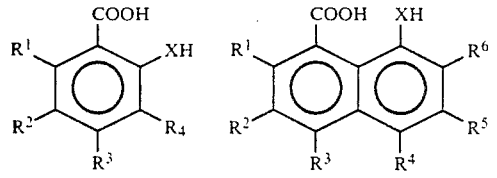

(I) (II)

in which X is O or S, and $R_1$, $R_2$, $R_3$, $R_4$, $R_5$ and $R_6$ are independently selected from the group consisting of hydrogen, lower alkyl, lower alkoxy, and halogen, wherein the concentration of the charge director in the liquid developer composition is such that substantially all of the charge director is associated with the toner particles in the form of said charged complexes.

In another aspect of the invention, a method for preparing such a liquid developer composition is provided, the method comprising dispersing toner particles and a charge director in an insulating carrier liquid, wherein the charge director is as described hereinabove and incorporated into the developer composition at a concentration below a certain, defined maximum value, i.e., so that substantially all of the charge director is present in the form of charged toner particle-charge director complexes and virtually no charge director is present in unassociated form.

In still another aspect of the invention, a method for using the composition is provided which involves developing an electrostatic charge pattern on a substrate by applying the novel liquid developer composition thereto. The images produced by this method have high reflection density and good resolution. The method is especially useful in consecutive color toning processes, in that (1) the necessity for drying the substrate after each color development step is eliminated, and (2) image staining is substantially reduced.

The invention is premised on the following:

- the discovery that trivalent metal salts of certain aromatic acids provide excellent charge directors, and give rise to extremely high quality—i.e., high density and high resolution—images;
- the discovery that maintaining the concentration of charge director in the developer composition below a certain well-defined maximum value, i.e., so that there is substantially no unassociated charge director in the carrier liquid, allows for consecutive color overtoning with virtually no image staining; and
- the importance of the counterion, and the discovery that self-stabilizing counterions give rise to positive charge directors and thus to a positive electrophotographic developing system, i.e., for developing negatively charged electrostatic images.

DETAILED DESCRIPTION OF THE PREFERRED EMBODIMENT

Figure 1:
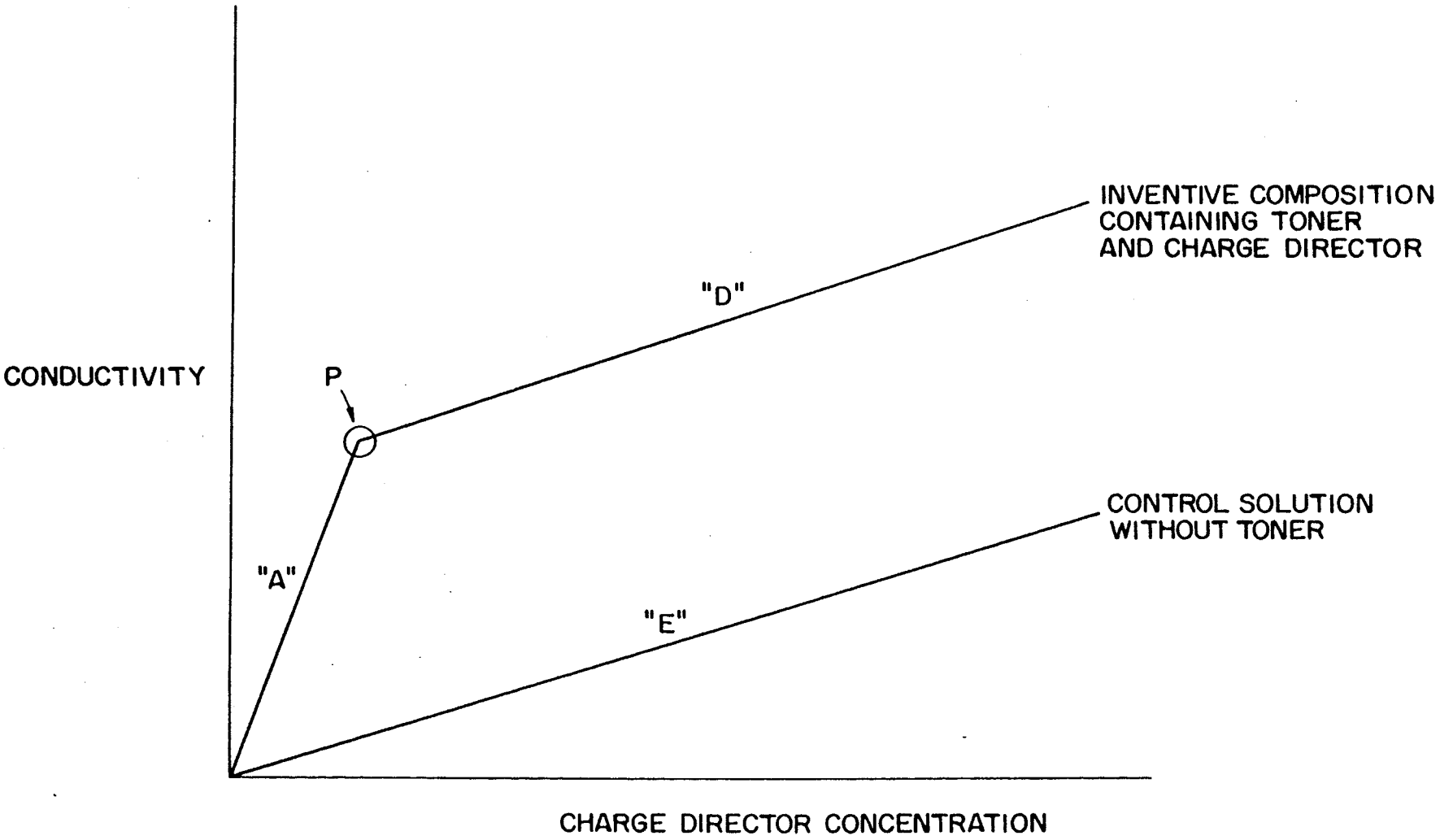

The presently claimed invention thus provides an improved electrophotographic liquid developer composition containing (i) toner dispersed in an electrically insulating carrier liquid, and (ii) a new class of charge directors: trivalent metal salts of selected aromatic acids represented by either formula (I) or (II) above.

This new class of charge directors has been found to provide a liquid developer composition which yields final images of extremely high resolution and density. While not wishing to be bound by theory, the inventor herein proposes that the unexpected advantages provided by the new class of charge directors derive from stabilization of charge on the toner particle. That is, as illustrated in Scheme 1, a charge director which is a trivalent metal salt of a selected aromatic acid will give rise to a charged toner particle which remains associated with the aromatic counterion. The free carboxyl and sulfhydryl or hydroxyl groups on the counterion stabilize the charge on the metal ion associated with the toner particle.

Scheme 1

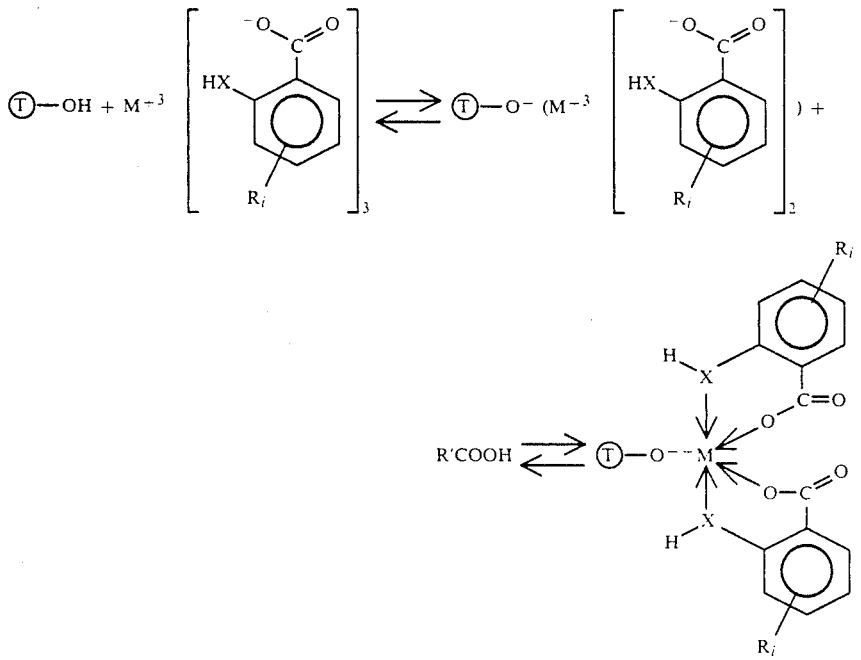

By contrast, analogous divalent metal salts will give rise to a system in which the metal ion is associated solely with surface anionic moieties on the toner particle and not with the counterion of the charge director. Thus, in the case of divalent metal salts of, for example, diisopropyl salicylic acid, there is no stabilization of the charge on the metal bound to the toner. This is illustrated in Scheme 2. It is accordingly proposed that the intramolecular stabilization of charge in the case of the trivalent salt is responsible for the higher quality images obtained with the present class of charge directors.

Scheme 2

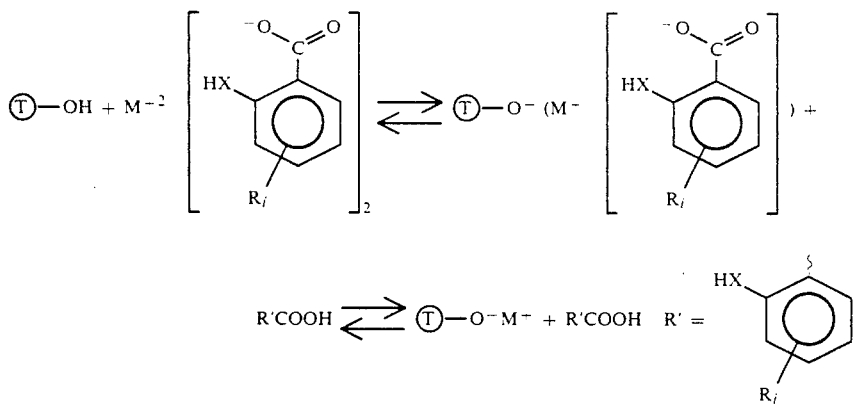

The preferred charge directors of the present invention, then, are trivalent metal salts of aromatic acids, wherein the aromatic acids can provide charge stabilization as illustrated in the above scheme. Particularly preferred charge directors within this class are trivalent metal salts of the aromatic acids represented by either formula (I) or (II) which are substantially soluble in the selected carrier liquid. While trivalent metal salts, generally, may be used, aluminum salts are particularly advantageous. Also, while the aromatic acids of formula (I) and (II) encompass a large number of species, the preferred species within those formulas are wherein X is oxygen and wherein the $R_i$ moieties are hydrogen or lower alkyl.

Another feature of the novel class of charge directors disclosed herein resides in the nature of the free counterion. That is, in the case of aluminum diisopropyl salicylate, the free counterion which remains in solution after charging of the toner particles, is diisopropyl salicylate (DIPS) itself. As illustrated in the following formula,

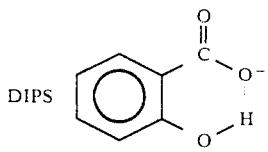

the negative charge on the carboxyl group is intramolecularly stabilized by the hydrogen atom in the ortho hydroxyl group. The inventor herein has discovered that the chemical structure of the counterion is determinative as to whether the developer composition will be useful for developing positive or negative images. It is now apparent that a self-stabilizing counterion such as DIPS gives a positive system, while a counterion such as

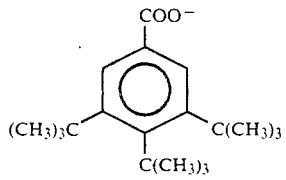

which is not self-stabilizing, gives a negative system. By "self-stabilizing" is meant the ability of a counterion to delocalize charge via intramolecular hydrogen bonding. Thus, because the ortho hydroxyl and carboxylate moieties of DIPS provide for intramolecular hydrogen bonding, DIPS gives rise to a positive system; the para hydroxyl and carboxylate groups of the above structure, by contrast, cannot give rise to intramolecular hydrogen bonding and accordingly produces a negative system. The preferred charge directors herein are thus positive.

An additional consideration in formulating a developer composition according to the invention relates to charge director concentration. Looking at FIG. 1, which provides conductivity-concentration curves for (1) a preferred liquid developer composition of the invention, and (2) a control solution without toner, it may be seen that there is a break point "P" in the conductivity-concentration curve for the composition containing both toner and charge director. This is the point at which the toner particles are unable to accept any additional charge; above point "P", there will be free, unassociated charge director in the carrier liquid. At charge director concentrations lower than that at point "P", by contrast, substantially all (i.e., greater than 90 wt. %, preferably greater than 99 wt. %) of the charge director is associated with toner particles. Thus, along line "A" one is actually charging the toner particles; charge director added into the composition in this region complexes with and thus charges the toner particles. At point "P", the toner particles are completely charged, while above point "P", i.e., along line "D", charge director that is unassociated with toner appears in the continuous phase. Predictably, the conductivity here reaches a constant slope virtually identical to that of line "E", the composition without toner. The compositions of the present invention contain charge director at a concentration lower than that at point "P", so that there is substantially no unassociated charge director in the composition. Conductivity is thus "particle-mediated".

Working at charge director concentrations along line "A", one obtains images of very high resolution. One is also able to overtone a first color image with a second color image without appreciable background staining. By contrast, charge director concentrations higher than that at point "P" tend to adversely affect recharging between color development steps, and result in background staining upon overtoning. The present invention, then, enables preparation of a liquid developer composition having an optimal charge director concentration which in turn provides for a consecutive color toning process in which image resolution is enhanced and background staining is minimized.

Still another consideration of the present invention is conductivity. That is, liquid developer compositions prepared according to the present invention should have a conductivity higher than that of analogous compositions without toner. The novel charge directors of the invention provide such a composition. This feature of the invention may perhaps be best understood by reference to FIG. 1. The control composition of FIG. 1 gives a conductivity profile defined by line "E". The composition of the invention containing both toner and the novel charge director gives a conductivity curve defined by lines "A" and "D". These conductivity values are higher than those along line "E" at all charge director concentrations.

The toner particles of the invention are prepared as follows. Resin, colorant, and the selected anti-static agent, are blended together at a temperature in the range of about 100° C. to 200° C. A two-roll mill, an extruder, and intensive mixer or the like, is used to ensure complete mixing. The admixture is then comminuted dry, that is, without addition of solvent, to give intermediate particles typically averaging 30 microns in diameter or less. This dry comminution step is carried out in a jet mill, a hammer mill, or the like. The intermediate particles so obtained are then subjected to liquid attrition in a selected solvent, to give the final toner particles. The solvent used for liquid attrition is typically selected from the same class of solvents useful as the carrier liquid for the developer composition, as will be described below.

The liquid developer composition is then prepared by dispersing the toner particles in an electrically insulating carrier liquid. As is well known in the art, carrier liquids for developer solutions may be selected from a wide variety of materials. The liquid is typically relatively oleophilic, stable under a variety of conditions, and has a low dielectric constant and a high electrical resistivity so as not to interfere with development of the electrostatic charge pattern. Preferably, the carrier liquid has a dielectric constant of less than about 3.5, more preferably less than about 3, and a volume resistivity greater than about $10^9$ ohm-cm, more preferably greater than about $10^{10}$ ohm-cm. Examples of suitable carrier liquids include halogenated hydrocarbon solvents such as carbon tetrachloride, trichloroethylene, and the fluorinated alkanes, e.g., trichloromonofluoromethane and trichlorotrifluoroethane (sold under the trade name "Freon" by the DuPont Company); acyclic or cyclic hydrocarbons such as cyclohexane, n-pentane, isooctane, hexane, heptane, decane, dodecane, tetradecane, and the like; aromatic hydrocarbons such as benzene, toluene, xylene, and the like; silicone oils; molten paraffin; and the paraffinic hydrocarbon solvents sold under the names Isopar G, Isopar H, Isopar K and Isopar L (trademarks of Exxon Corporation). The foregoing list is intended as merely illustrative of the carrier liquids which may be used in conjunction with the present invention, and is not in any way intended to be limiting.

The resins and colorants which may be used in formulating the toner particles may, like the carrier liquid, be selected from a wide variety of materials well known in the art of electrophotography.

Resins useful in liquid electrophotographic developers, generally, are characterized as being insoluble or only slightly soluble in the insulating carrier liquid, i e , they are "oleophobic". Examples of suitable resins for use herein include: alkyd and modified alkyd resins cured with polyisocyanate, melamine formaldehyde or benzoguanamine; epoxy ester resins; polyester resins; copolymers of styrene, acrylic and methacrylic esters with hydroxyethyl methacrylate, hydroxyethyl acrylate, hydroxypropyl methacrylate, or the like; other polyacrylates; phenolic resins such as phenol formaldehyde resins and derivatives thereof; ethylene-acrylic acid copolymers; ethylene-vinyl alcohol copolymers and ionomers thereof; styrene-allyl alcohol copolymers; and cellulose acetate-butyrate copolymers; and polyethylene and polyethylene copolymers.

The colorants which may be used include virtually any pigments, dyes and stains which may be suspended in the carrier liquid and which are effective to make visible the electrostatic latent image. Examples of suitable colorants include: Phthalocyanine blue (C.I. 74160), Diane blue (C.I. 21180), Milori blue (an inorganic pigment equivalent to ultramarine) as cyan colorants; Brilliant carmine 6B (C.I. 15850), Quinacridone magenta (C.I. Pigment Red 122) and Thioindigo magenta (C.I. 73310) as magenta colorants; benzidine yellow (C.I. 21090 and C.I. 21100) and Hansa Yellow (C I. 11680) as yellow colorants; and black materials such as carbon black, charcoal and other forms of finely divided carbon, iron oxide, zinc oxide, titanium dioxide, and the like.

The optimal weight ratio of colorant to resin in the toner particles is on the order of about 1:1 to 25:1, more preferably about 5:1 to 15:1. The total dispersed material in the carrier liquid typically represents 0.5 to 5 wt. % of the composition.

The selected charge director may be incorporated into the developer composition either at or after the comminution stage, in an amount calculated as described above.

The developer composition may include other components as desired, including dispersants, stabilizers, antistatic agents and an incompatible phase such as a wax. As described in copending, commonly assigned U.S. patent application Ser. No. 07/355,484, filed 23 May 1989 and entitled "Fine Particle Electrophotographic Toner and Developer Compositions and Process Therefor" (the disclosure of which is hereby incorporated by reference), inclusion of an incompatible material in the toner particles substantially prevents pigment exposure and particle aggregation.

As described in detail in the above-cited patent application, the incompatible phase may be any material which can be directly incorporated into the toner particles using the above-described comminution process. Particularly preferred materials for use as the incompatible phase are waxes, e.g., carnauba wax, beeswax, paraffin waxes, polyethylene waxes, ethylene-propylene copolymer waxes, long-chain petroleum waxes, and other waxes as described in U.S. Pat. Nos. 3,060,021 and 4,081,391, both of which are incorporated herein by reference.

Examples of preferred antistatic agents for incorporation into the composition are ethoxylated sorbitan monooleate, ethoxylated oleic acids, ethoxylated oleyl alcohol, and carbowaxes, all of which have been found to aid in reducing the problem of background staining. See, for further information, copending patent application Ser. No. 07/356,264, inventor Ron Swidler, entitled "Stain Elimination in Consecutive Color Toning", filed 23 May 1989 and incorporated by reference herein. As described in detail in that application, the antistatic agent may be incorporated into the composition initially, i.e., when the toner particles are prepared, or it may be added into the carrier liquid after the toner particles have been dispersed therein, or both. It is preferable that the antistatic agent be incorporated into the liquid developer composition at the outset, that is, during preparation of the toner particles.

With respect to the method of use, liquid developer compositions formulated with the novel class of charge directors may be used to develop electrostatic images in electrophotographic processes as well known in the art. Briefly, such a method involves forming an electrostatic image on a selected substrate, e.g., by ionization from a corona discharge. The developer composition is applied to the electrostatic image, and, by virtue of the pigment or dye contained within the toner particles, renders the image visible. As emphasized throughout this application, liquid developer compositions prepared with the novel class of charge directors are particularly useful in consecutive color toning processes. In such a process, a photoconductive surface is charged and exposed through a color transparency, and developed with a liquid developer composition of a first color. The photoconductive surface is discharged, and the process is repeated, typically with magenta, cyan, and black developer compositions.

The following examples are intended to be illustrative of the advantages of the present invention.

EXAMPLE 1

Figure 2:
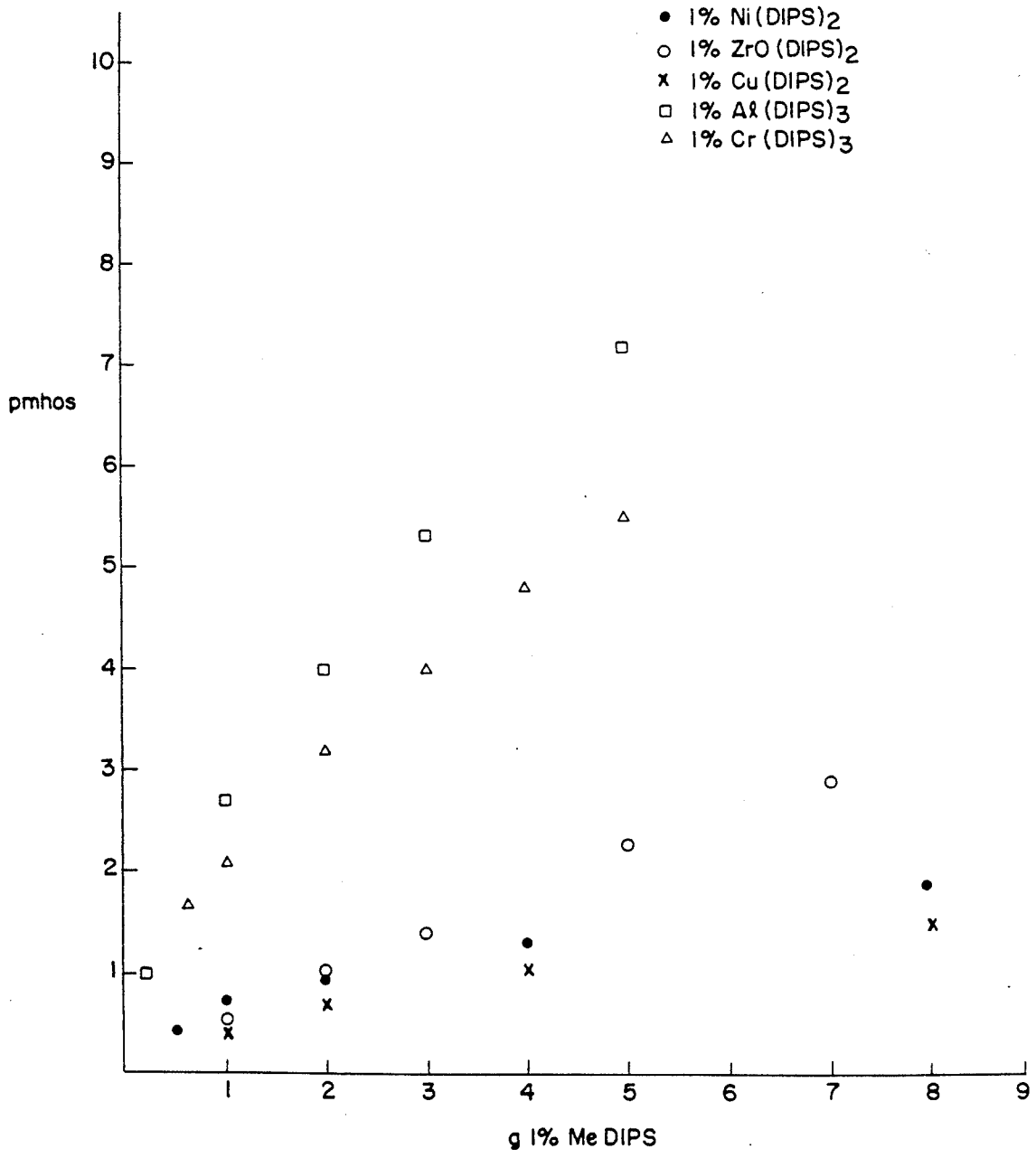
Figure 3:
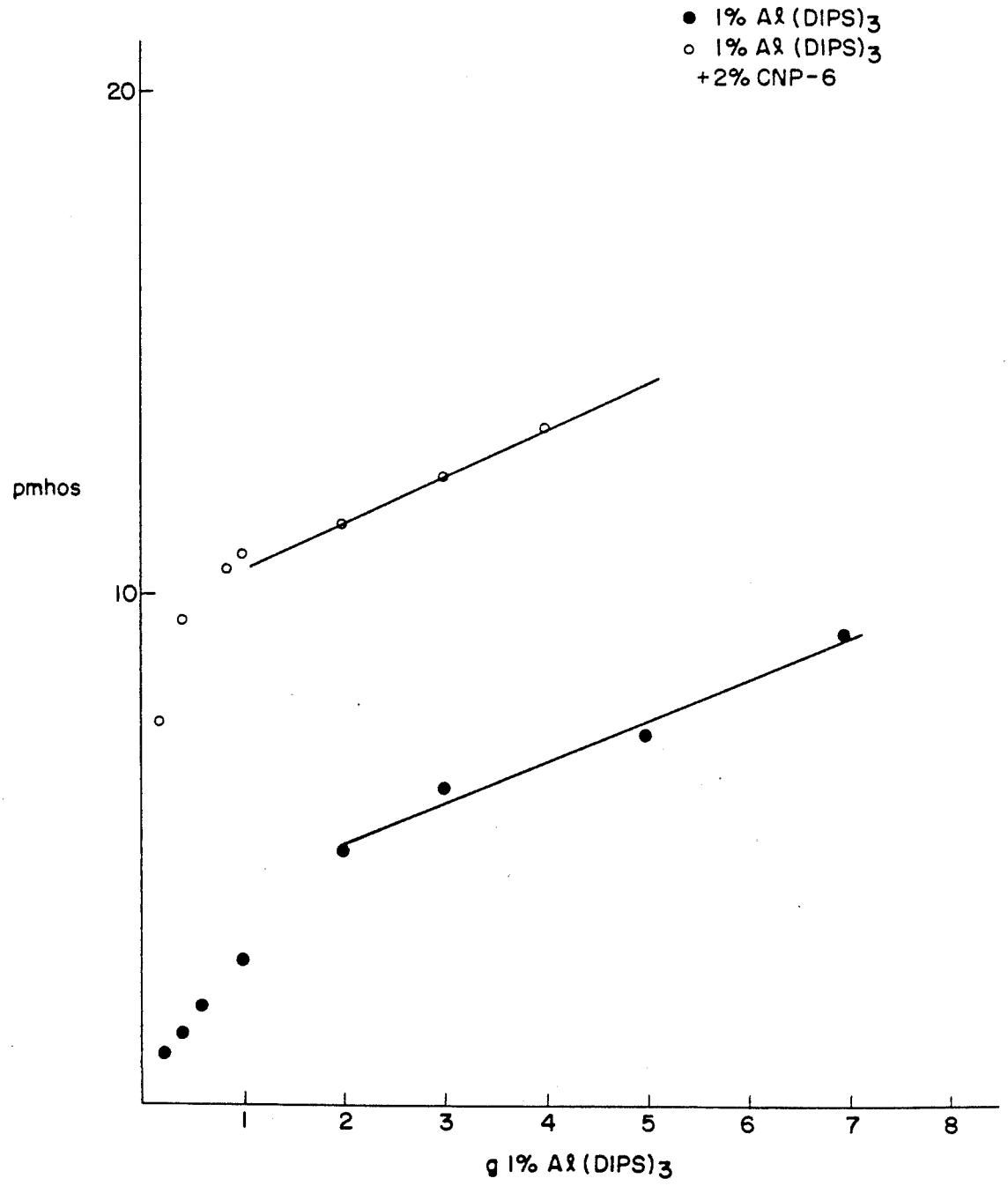
Figure 4:
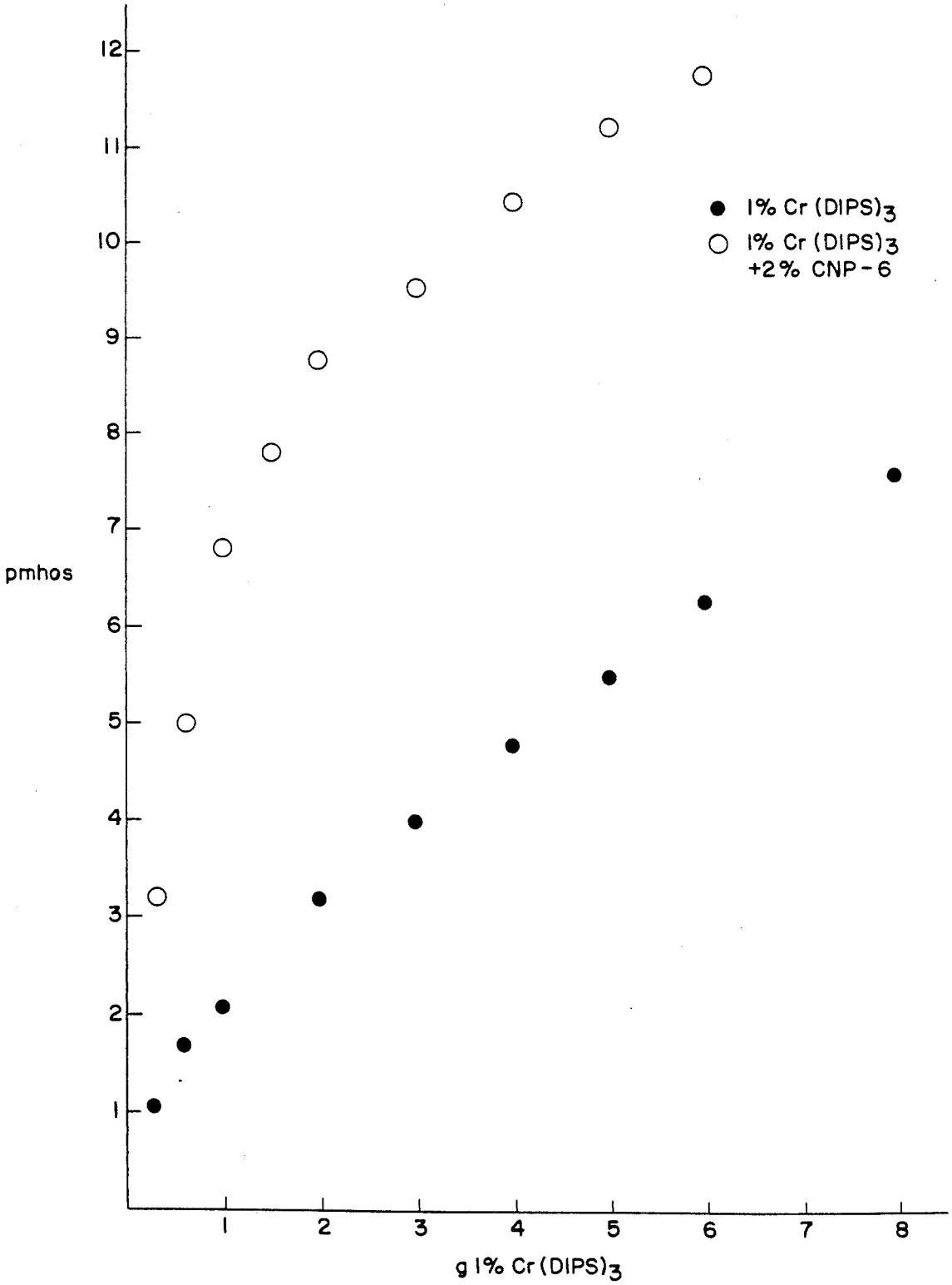
Figure 5:
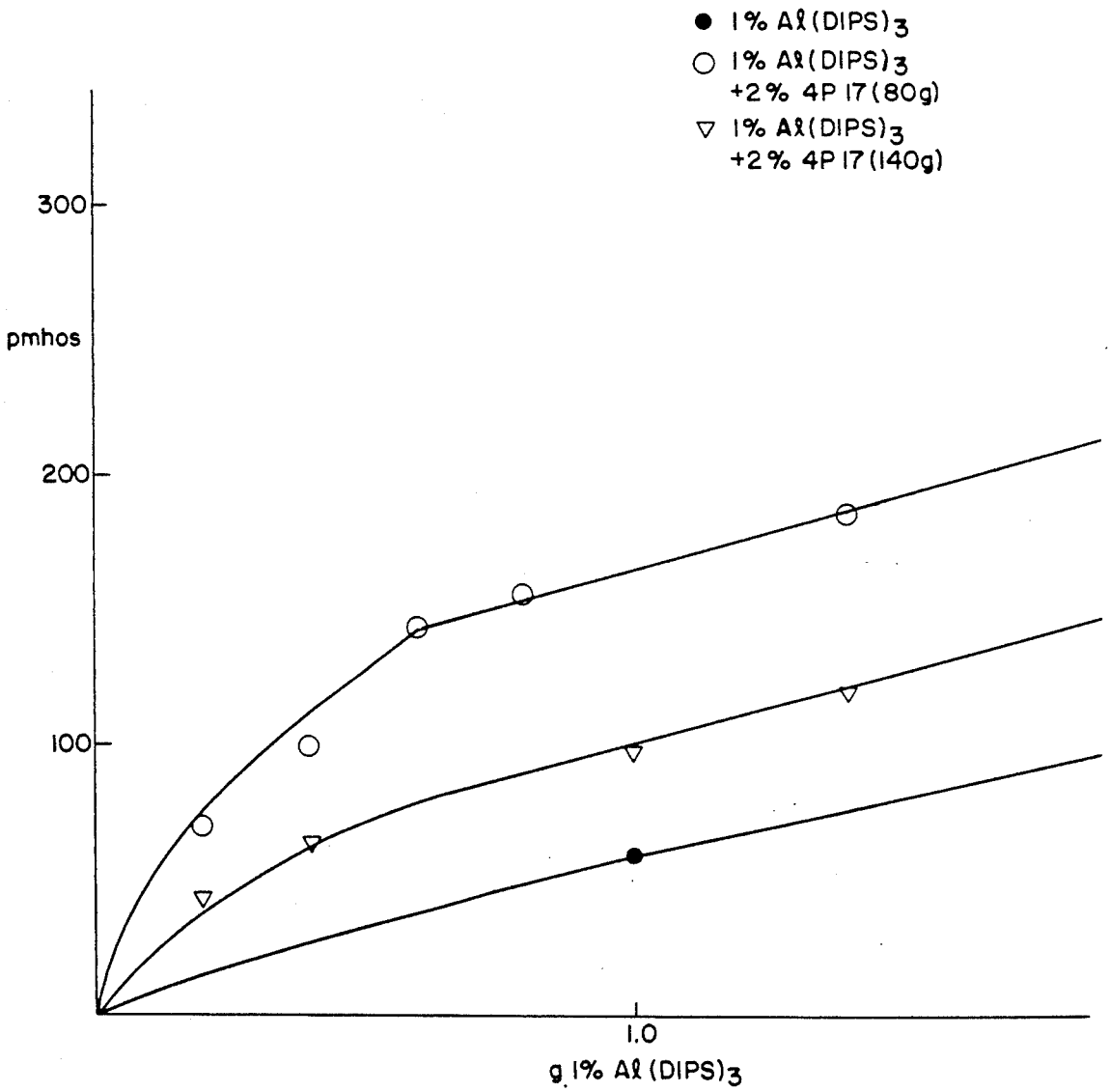
Figure 6:
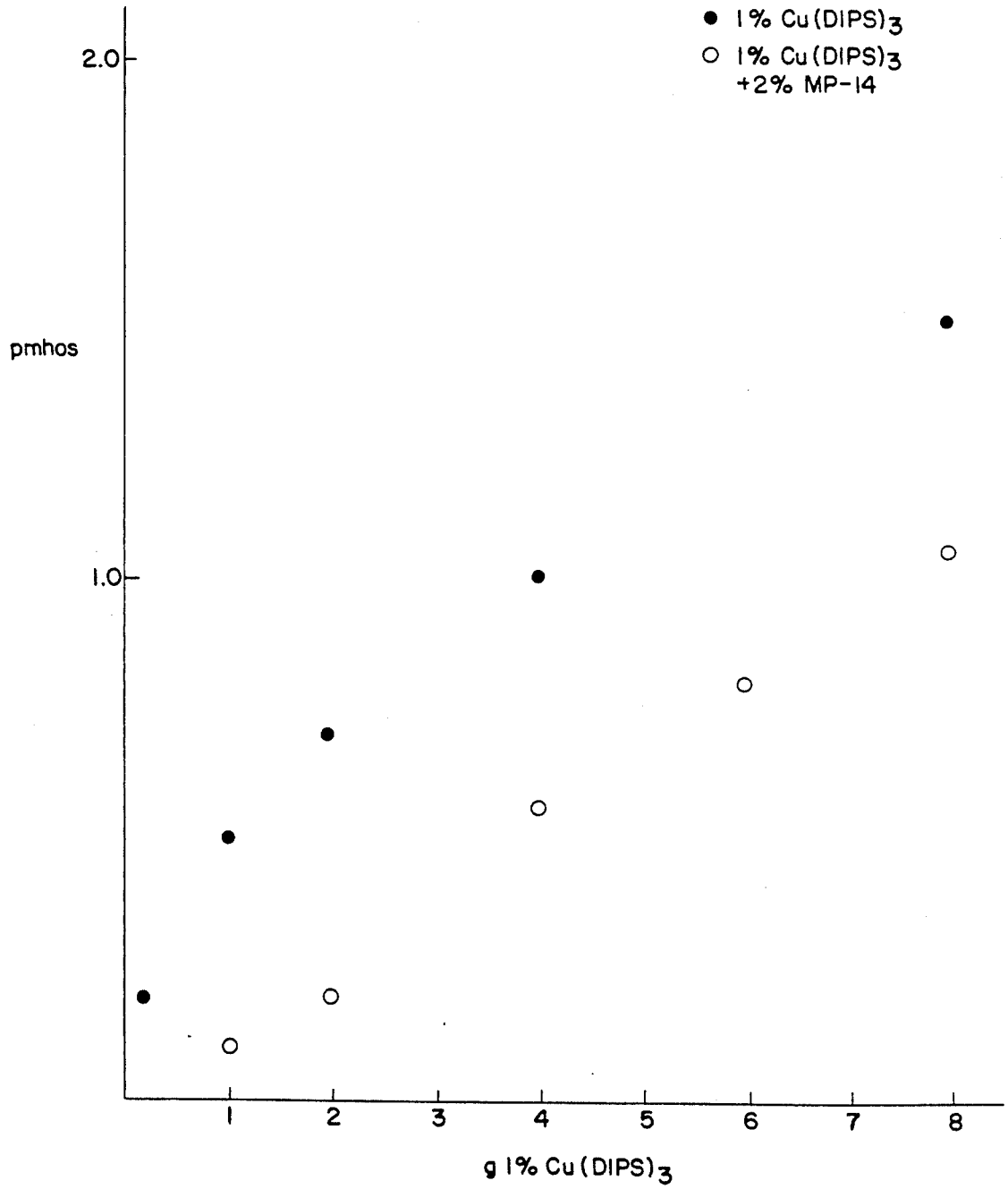
Figure 7:
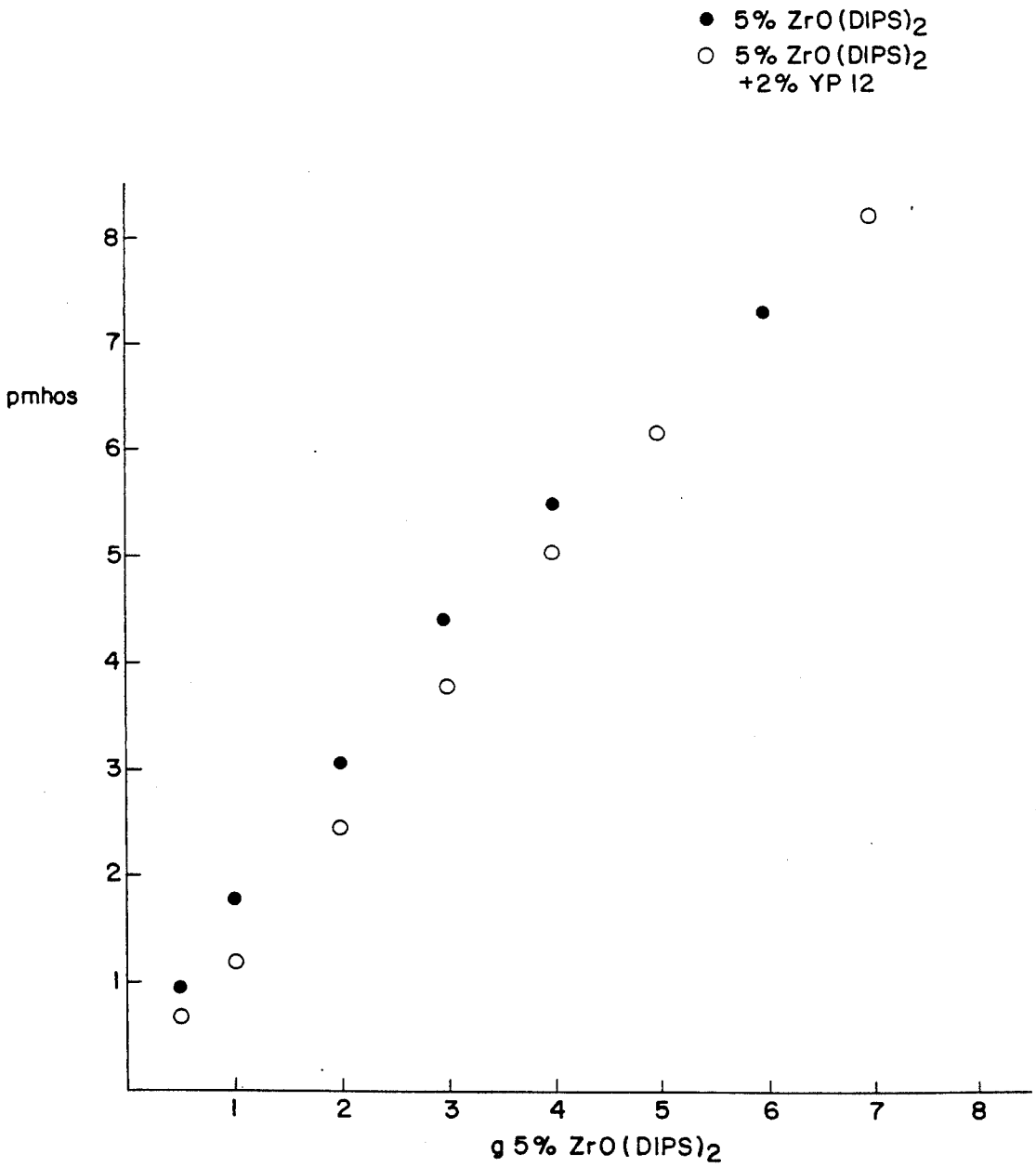
Figure 8:
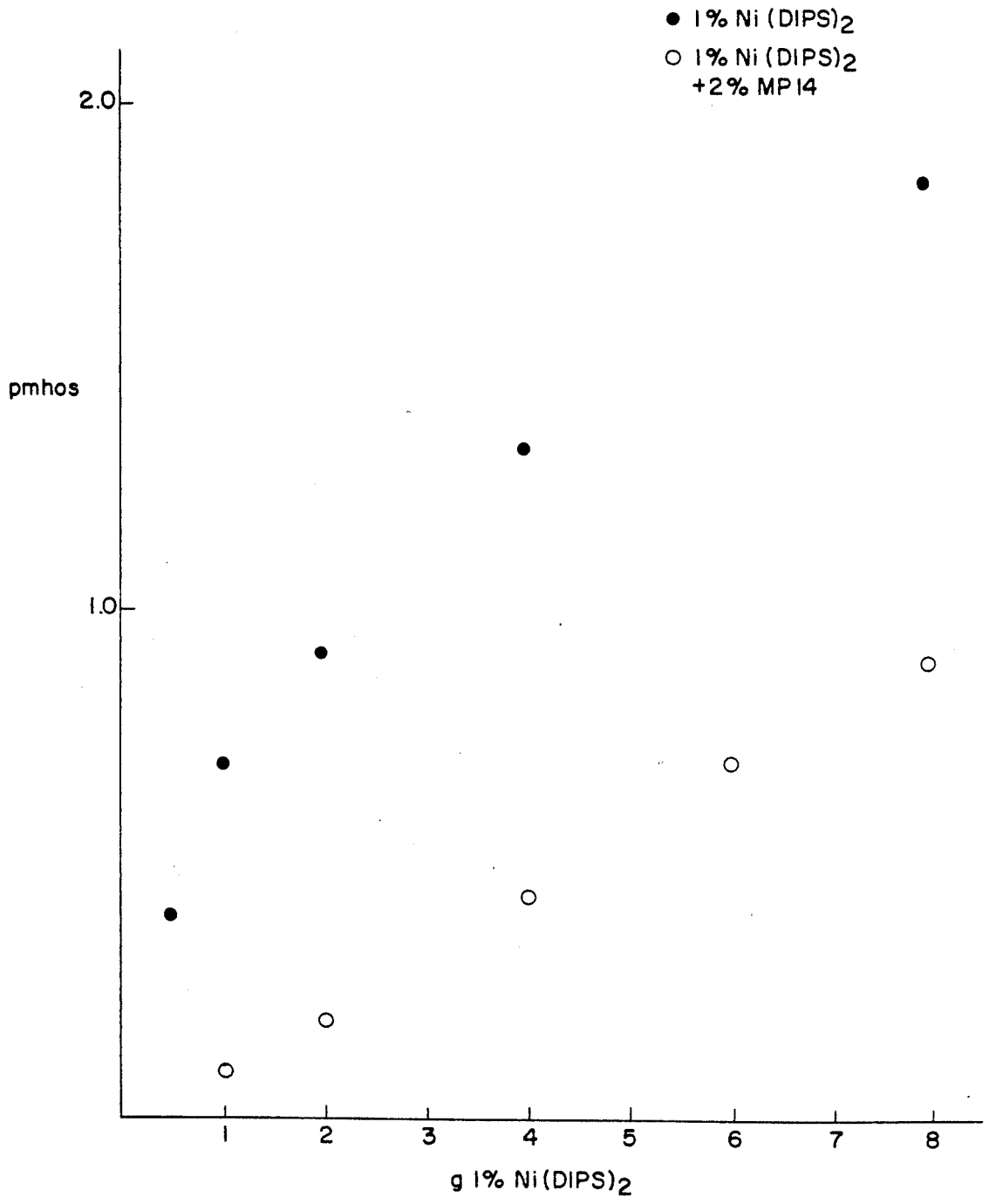

The differences in conductivity of divalent and trivalent metal salts of diisopropyl salicylate were explored as follows. Five stock solutions were prepared: (1) 1.0 wt. % $Ni(DIPS)_2$; (2) 1.0 wt. % $ZrO(DIPS)_2$; (3) 1.0 wt. % $Cu(DIPS)_2$; (4) 1.0 wt. % $Al(DIpS)_3$; and (5) 1.0 wt. % $Cr(DIPS)_3$. Varying amounts of these solutions were added into Isopar G (Exxon), and the conductivity of the solutions was measured as a function of concentration. Results are summarized graphically in FIG. 2. As may be readily determined from that graph, $Al(DIPS)_3$ and $Cr(DIPS)_3$ gave the highest conductivities at all concentrations. This would appear to be a result of stabilization of the positive charge on the metallic organic ion by the ortho hydroxyl groups as in

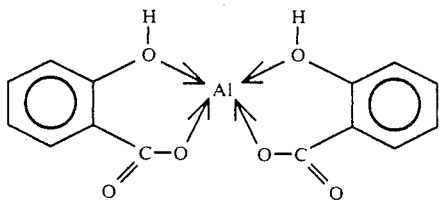

Clearly, the ion resulting from the ionization of the divalent metal salts cannot be equally stabilized.

EXAMPLES 2-7

The stock solutions prepared in Example 1 were then used to conductimetrically titrate standard toner samples as indicated in Table 1.

TABLE 1

| Example | Figure | Charge Director | Toner Sample |
|---|---|---|---|
| 2 | 3 | 1.0 wt. % $Al(DIPS)_3$ | 2.0 wt. % CNP-6 (400 g) |
| 3 | 4 | 1.0 wt. % $Cr(DIPS)_3$ | 2.0 wt. % CNP-6 (400 g) |
| 4 | 5 | 1.0 wt. % $Al(DIPS)_3$ | (a) 10.0 wt. % |

TABLE 1-continued

| Example | Figure | Charge Director | Toner Sample |
|---|---|---|---|
| | | | 4P17 (80 g) |
| | | | (b) 10.0 wt. % |
| | | | 4P17 (140 g) |
| 5 | 6 | 1.0 wt. % $Cu(DIPS)_3$ | 2.0 wt. % MP-14 (400 g) |
| 6 | 7 | 5.0 wt. % $ZrO(DIPS)_2$ | 2.0 wt. % VP-12 (400 g) |
| 7 | 8 | 1.0 wt. % $Ni(DIPS)_2$ | 2.0 wt. % MP-14 (400 g) |

In each of Examples 2–7, a 1.0% charge director solution was titrated into 400 g of Isopar H (Exxon) as a control The other curves were generated by titration into the toner samples as indicated.

In Example 2, the curve generated by addition of 1.0 wt. % $Al(DIPS)_3$ into 400 g of 2 wt. % toner gave, up to about 0.5 g, a positively charged toner which produced excellent images on a zinc oxide photoconductor. When this image was overtoned with a second color at various levels of added charge director, quite satisfactory binary images were obtained, i.e., with a minimum of background staining. Above 0.5 g, background staining was observed in the final image. The $Cr(DIPS)_3$ behaved similarly.

As expected, the $ZrO(DIPS)_2$ and $Ni(DIPS)_2$ developers gave poor image resolution and resulted in a high degree of background staining upon overtoning.

What is claimed is:

1. An electrophotographic liquid developer composition comprising, dispersed in an electrically insulating carrier liquid, (a) toner particles of a resinous phase containing a colorant, and (b) a charge director soluble in said carrier liquid which associates with the toner particles to form charged complexes, wherein the charge director consists essentially of a salt of a trivalent metal and an aromatic acid represented by either of structures (I) or (II)

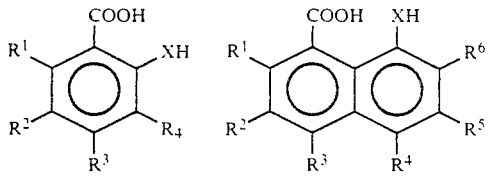

(I) (II)

in which X is O or S, and $R_1$, $R_2$, $R_3$, $R_4$, $R_5$ and $R_6$ are independently selected from the group consisting of hydrogen, lower alkyl, lower alkoxy, and halogen, wherein the concentration of the charge director in the liquid developer composition is less than the amount which will saturate the toner particles, such that substantially all of the charge director is associated with the toner particles in the form of said charged complexes, whereby the conductivity of the composition is particle-mediated.

2. The composition of claim 1, wherein the trivalent metal is aluminum.

3. The composition of claim 1, wherein the aromatic acid is diisopropyl salicylic acid.

4. The composition of claim 2, wherein the aromatic acid is diisopropyl salicylic acid.

5. The composition of claim 1, wherein the toner particles contain a separate, solid oleophilic phase.

6. The composition of claim 5, wherein the oleophilic phase comprises wax.

7. The composition of claim 1, further comprising an antistatic agent.

8. An electrophotographic liquid developer composition comprising, dispersed in an electrically insulating carrier liquid, (a) toner particles of (i) a resinous phase containing a colorant, and (ii) a separate, solid oleophilic phase, (b) a charge director soluble in said carrier liquid which associates with the toner particles to form charged complexes, wherein the charge director consists essentially of a salt of a trivalent metal and an aromatic acid represented by either of structures (I) or (II)

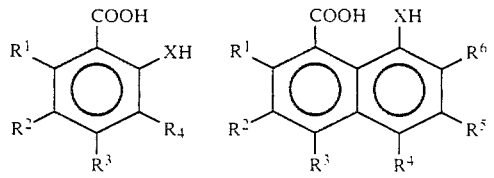

(I) (II)

in which X is O or S, and $R_1$, $R_2$, $R_3$, $R_4$, $R_5$ and $R_6$ are independently selected from the group consisting of hydrogen, lower alkyl, lower alkoxy, and halogen, and (c) an antistatic agent, wherein the concentration of the charge director in the liquid developer composition is less than the amount which will saturate the toner particles, such that substantially all of the charge director is associated with the toner particles in the form of said charged complexes, whereby the conductivity of the composition is particle-mediated.

9. The composition of claim 8, wherein the charge director is aluminum diisopropyl salicylate.

10. A method for making an electrophotographic liquid developer composition, which comprises:

dispersing, in an electrically insulating carrier liquid, (a) toner particles of a resinous phase containing a colorant, and (b) a charge director soluble in said carrier liquid which associates with the toner particles to form charged complexes, wherein the charge director consists essentially of a salt of a trivalent metal and an aromatic acid represented by either of structures (I) or (II)

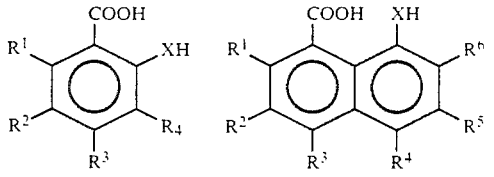

(I) (II)

in which X is O or S, and $R_1$, $R_2$, $R_3$, $R_4$, $R_5$ and $R_6$ are independently selected from the group consisting of hydrogen, lower alkyl, lower alkoxy, and halogen, wherein the concentration of the charge director in the liquid developer composition is less than the amount which will saturate the toner particles, such that substantially all of the charge director is associated with the toner particles in the form of said charged complexes, whereby the conductivity of the composition is particle-mediated.

11. The method of claim 10, which further comprises incorporating a separate, solid oleophilic phase into the toner particles prior to said dispersing.

12. The method of claim 11, wherein the oleophilic phase comprises wax.

13. The method of claim 10, which further comprises dispersing an antistatic agent into said composition.

14. The method of claim 11, which further comprises dispersing an antistatic agent into said composition.

15. A process for developing an electrostatic charge pattern, which comprises:

forming an electrostatic charge pattern on a substrate;

preparing a liquid developer composition for developing the charge pattern by dispersing, in an electrically insulating carrier liquid, (a) toner particles of a resinous phase containing a colorant, and (b) a charge director soluble in said carrier liquid which associates with the toner particles to form charged complexes, wherein the charge director consists essentially of a salt of a trivalent metal and an aromatic acid represented by either of structures (I) or (II)

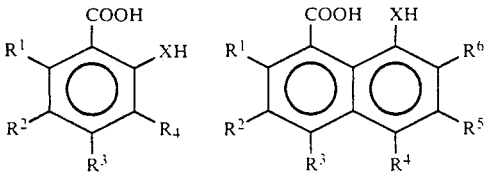

(I) (II)

in which X is O or S, and $R_1$, $R_2$, $R_3$, $R_4$, $R_5$ and $R_6$ are independently selected from the group consisting of hydrogen, lower alkyl, lower alkoxy, and halogen, wherein the concentration of the charge director in the liquid developer composition is less than the amount which will saturate the toner particles, such that substantially all of the charge director is associated with the toner particles in the form of said charged complexes, whereby the conductivity of the composition is particle-mediated; and developing the pattern by applying the liquid developer composition thereto.

16. A process for developing an electrostatic charge pattern, which comprises:

forming an initial electrostatic charge pattern on an insulating substrate;

developing the initial pattern with a first liquid developer composition comprising toner particles of a resinous phase containing a first colorant dispersed in a insulating carrier liquid, and a first charge director that associates with and thereby forms a charged complex with the toner particles;

forming a second electrostatic charge pattern on the substrate; and developing the second pattern with a second liquid developer composition comprising toner particles of a resinous phase containing a second colorant dispersed in an insulating carrier liquid, and a second charge director that associates with and thereby forms a charged complex with the toner particles, wherein each of said first and second charge directors, which may be the same or different, is a salt of a trivalent metal and an aromatic acid represented by either of structures (I) or (II)

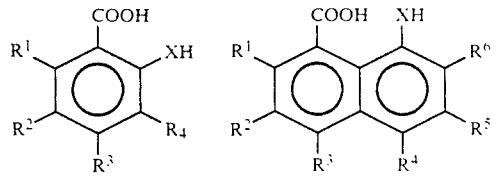

(I) (II)

in which X is O or S, and $R_1$, $R_2$, $R_3$, $R_4$, $R_5$ and $R_6$ are independently selected from the group consisting of hydrogen, lower alkyl, lower alkoxy, and halogen, wherein the concentration of the charge director in the liquid developer composition is less than the amount which will saturate the toner particles, such that substantially all of the charge director is associated with the toner particles in the form of said charged complexes, whereby the conductivity of the composition is particle-mediated.

17. The composition of claim 16, wherein the charge director is aluminum diisopropyl salicylate.

* * * * *